US007503663B2

(12) United States Patent
Boyer et al.

(10) Patent No.: US 7,503,663 B2
(45) Date of Patent: Mar. 17, 2009

(54) INFRARED REFLECTIVE TAPE SQUARES

(75) Inventors: Thomas R. Boyer, Gambrills, MD (US); Douglas B. Armentrout, Purcellville, VA (US)

(73) Assignee: TVi Corporation, Glenn Dale, MD (US)

( * ) Notice: Subject to any disclaimer, the term of this patent is extended or adjusted under 35 U.S.C. 154(b) by 0 days.

(21) Appl. No.: 11/441,279

(22) Filed: May 25, 2006

(65) Prior Publication Data

US 2007/0102636 A1 May 10, 2007

Related U.S. Application Data

(60) Provisional application No. 60/684,368, filed on May 25, 2005.

(51) Int. Cl.
*G02B 5/12* (2006.01)

(52) U.S. Cl. ..... 359/515

(58) Field of Classification Search ..... 359/515–519
See application file for complete search history.

(56) References Cited

U.S. PATENT DOCUMENTS

| | | | | |
|---|---|---|---|---|
| 4,467,005 | A | 8/1984 | Pusch et al. | |
| 6,309,497 | B1 * | 10/2001 | Gordon et al. | 156/234 |
| 6,701,649 | B1 | 3/2004 | Brosi | |
| 7,021,549 | B2 * | 4/2006 | O'Rell et al. | 235/488 |

* cited by examiner

*Primary Examiner*—Euncha P Cherry
(74) *Attorney, Agent, or Firm*—Whiteford, Taylor & Preston LLP; Jeffrey C. Maynard; Gregory M. Stone

(57) ABSTRACT

An elongated strip of release paper supports infrared reflective tape releasably attached to the backing paper. The infrared reflective tape is cut to form segments that can be dispensed like labels that can be held in place by an adhesive backing to enable the segment of reflective tape to be sewn in place on a garment. Infrared reflective segments can be dispensed from a roll on a spool using a manual label dispenser.

10 Claims, 2 Drawing Sheets

INFRARED REFLECTIVE TAPE SQUARES

CROSS REFERENCE TO RELATED APPLICATION

This application is based upon and claims benefit of copending and co-owned U.S. Provisional Patent Application Ser. No. 60/684,368 entitled "Infrared Reflective Tape Squares", filed with the U.S. Patent and Trademark Office on May 25, 2005 by the inventors herein, the specification of which is incorporated herein by reference.

BACKGROUND OF THE INVENTION

1. Field of the Invention

This invention generally relates to a method and system for adding an infrared reflective marker to a clothing article and, more particularly, but not by way of limitation, to a method of dispensing infrared reflective marking material for ease of handling.

2. Background of the Prior Art

Typically, infrared reflective marking material is sewn on clothing, such as military uniforms and other items, to aid in identifying friendly forces. The marking material is generally supplied in pre-cut ¾ inch×¾ inch squares that are delivered in bags or bins in a standard quantity. The product, as supplied, is difficult to use in the supplied configuration because the pieces are too small to handle effectively while sewing onto the clothing. Additionally, it is difficult to grasp a single small square from the bag or storage bin without grasping numerous pieces. Such small size makes the process of attaching such marking material to the clothing laborious and time consuming.

There remains a need for a simple device that can improve the handling capability of such reflective pieces both in selecting a single piece for use and in holding the reflective marker in place for attachment to a garment.

Furthermore, there remains a need for a dispensing system for infrared reflective pieces that enables more efficient and faster delivery of such reflective pieces for attachment to a garment.

SUMMARY OF THE INVENTION

It is, therefore, an object of the present invention to provide a delivery method for infrared reflective pieces that avoids the disadvantages of the prior art.

It is another object of the present invention to provide standard size infrared reflective pieces that have a releasable adhesive backing. A further related object is to provide standard size infrared reflective pieces that are attachable to a garment or the like. A further related object is to provide standard size infrared reflective pieces that remain in place for ease of sewing to a garment or the like.

Another object of the present invention is to provide standard size infrared reflective pieces on a spool of paper or plastic tape. A related object is to provide a spool of standard size infrared reflective pieces that can be used with a manual label dispenser.

The various features of novelty that characterize the invention will be pointed out with particularity in the claims of this application.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF EXEMPLARY EMBODIMENTS

The invention summarized above and defined by the enumerated claims may be better understood by referring to the following description, which should be read in conjunction with the accompanying drawings in which like reference numbers are used for like parts. This description of an embodiment, set out below to enable one to practice an implementation of the invention, is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
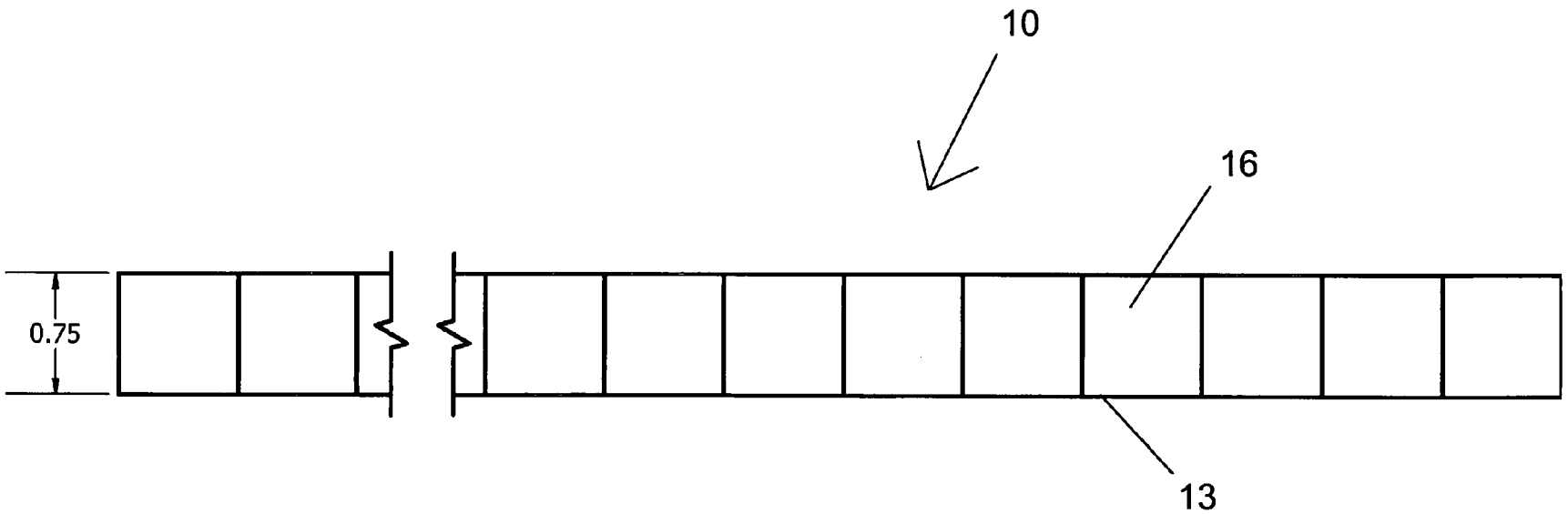
FIG. 1 shows a plan view of a strip of reflective marker material according to one embodiment of the present invention.

Referring to the drawings, FIG. 1 shows a strip, indicated generally as 10, of reflective marker material 16 releasably adhered to a carrier web 13. In a preferred embodiment, the dimension of the overall length of the strip 10 is significantly longer than the dimension of the width of said strip 10. For example, in some embodiments, strip 10 may be approximately ¾ inch wide and approximately 150 feet long. Of course, other sizes of length and width may be used.

Figure 2:
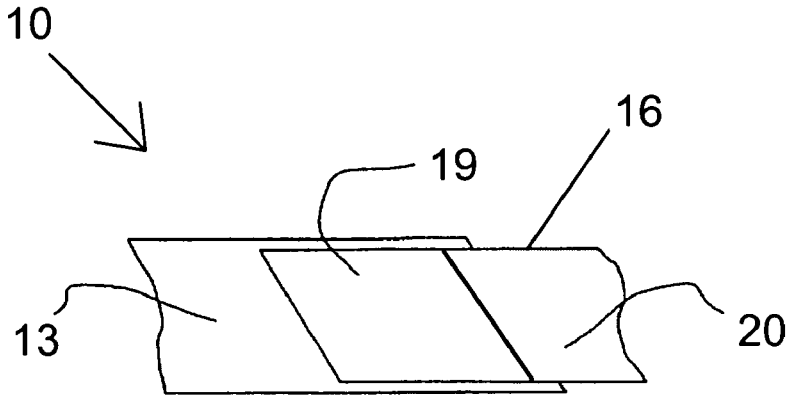
FIG. 2 shows a perspective view of a part of a strip of reflective marker material according to one embodiment of the present invention.

Referring to FIG. 2, the strip 10 comprises an elongated carrier web 13 having reflective material 16 transported thereon. In a preferred embodiment, such carrier web 13 may be an elongated ribbon of release paper. The carrier web 13 may be formed of conventional substance for this purpose, such as backing paper, nylon, plastic, cloth weave, and the like. The reflective material 16 preferably has a cloth knit surface on the back and a reflective surface on the top. The reflective surface should have reflective properties in the near infrared to infrared wavelength enabling viewing by light intensifier/night vision equipment, such as so-called night vision tape. In some embodiments, the reflective material 16 may be a type of luminous tape designed to reflect white light, making it visible in the dark. Alternatively, phosphorescent tape that absorbs white light and then glows in the dark may be used. The reflective material 16 is butt cut up to, but not through, the carrier web 13 to form a plurality of reflective segments, such as 19, 20. In a preferred embodiment, segments 19, 20 will be rectangular in shape and may approximate a square piece having uniform length and width dimensions. While a typical reflective marker piece is approximately ¾ inch×¾ inch square, it is within the skill in the art to establish the length for cutting such segments 19, 20.

The reflective material 16 is releasably held to the carrier web 13 by an appropriate adhesive. The adhesive should be applied to the reflective tape 16 and enable the reflective material 16 to releasably adhere to the carrier web 13. Additionally, the adhesive should enable the segments 19, 20, upon removal from the carrier web 13, to temporarily adhere to the fabric of whatever garment to which such segment is to be attached. A sufficiently small amount of adhesive should prevent residual adhesive becoming affixed to the reflective top surface.

Figure 3:
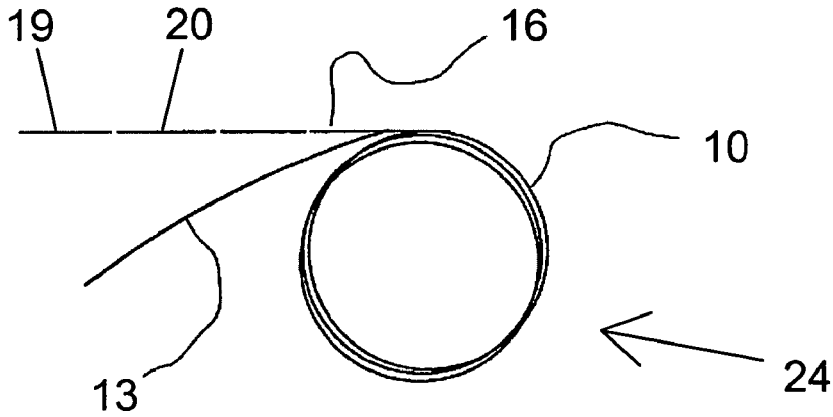
FIG. 3 shows a rolled strip of reflective marker material according to one embodiment of the present invention.

In practice, the strip 10 of reflective marker material 16 releasably adhered to the carrier web 13 may be delivered as a roll 24, as shown in FIG. 3. The segments 19, 20 can be dispensed in the form of labels from the roll 24 on a spool or like device. In the roll format, a standard label dispenser can be used to make dispensing fast and easy. A segment, such as 19 or 20, can be removed from the carrier web 13 and temporarily affixed to a garment in a desired position. The adhesive holds the segment in place to enable it to be sewn in place to the garment. A user can peel off individual segments, as desired, and place the segments before sewing. In the roll configuration, several hundred segments can be delivered on a single roll 24.

It will be appreciated by persons skilled in the art that numerous variations and/or modifications may be made to the invention as shown in the specific embodiments without departing from the spirit or scope of the invention as broadly described. Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein. The present embodiments are, therefore, to be considered in all respects as illustrative and not restrictive.

What is claimed is:

1. A marker, comprising:

an elongate carrier web;

marker material disposed on said carrier web, said marker material comprising:

an adhesive on only one side to releasably attach said marker material to said carrier web; and a reflective surface covering substantially all of a side of said marker material opposite from said adhesive and away from said carrier web; wherein said marker material is cut up to but not through said carrier web to form a plurality of marker segments.

2. The marker of claim 1, wherein said carrier web is significantly longer in length dimension than in width dimension.

3. The marker of claim 1, wherein said reflective surface has passive reflective properties in the near infrared to infrared wavelength.

4. The marker of claim 1, wherein said marker material comprises luminous tape designed to reflect white light.

5. The marker of claim 1, wherein said marker material comprises phosphorescent tape that absorbs white light and glows in the dark.

6. The marker of claim 1, said marker material further comprising a cloth backing.

7. The marker of claim 1, wherein said adhesive remains on said marker material upon removal from said carrier web and enables said marker material to be at least temporarily affixed to a garment.

8. The marker of claim 1, said carrier web being selected from the group consisting of:

paper;

nylon;

plastic;

cloth; and combinations of the above.

9. The marker of claim 1, wherein said marker segments are rectangular.

10. The marker of claim 9, wherein said marker segments are substantially square.

* * * * *